US005522245A

United States Patent [19]

Nozaki et al.

[11] Patent Number: 5,522,245

[45] Date of Patent: Jun. 4, 1996

[54] DEVICE FOR PRODUCING METAL RINGS

[75] Inventors: Kimio Nozaki; Mutuo Yomoda, both of Tokyo, Japan

[73] Assignee: Calsonic Corporation, Tokyo, Japan

[21] Appl. No.: 285,731

[22] Filed: Aug. 4, 1994

[30] Foreign Application Priority Data

Feb. 21, 1994 [JP] Japan ..... 022673

[51] Int. Cl.[6] ..... B21B 39/02; B21D 5/14; B21D 9/10

[52] U.S. Cl. ..... 72/133; 72/169; 72/166; 72/134; 72/107

[58] Field of Search ..... 72/107, 133, 134, 72/166, 169, 108

[56] References Cited

U.S. PATENT DOCUMENTS

| | | | |
|---|---|---|---|
| 2,043,665 | 6/1936 | Iversen et al. | 153/61 |
| 2,686,442 | 8/1954 | Wilson | 72/107 |
| 2,886,990 | 5/1959 | Bregi | 72/105 |
| 3,205,689 | 9/1965 | Joseph | 72/146 |
| 3,431,622 | 3/1969 | Amthor et al. | 29/204 |
| 3,842,473 | 10/1974 | Couper | 72/169 |
| 4,730,477 | 3/1988 | Redman | 72/424 |
| 4,777,816 | 10/1988 | Inoue | 72/166 |
| 5,228,322 | 7/1993 | Del Fabro et al. | 72/424 |

FOREIGN PATENT DOCUMENTS

| | | |
|---|---|---|
| 497212 | 10/1970 | Switzerland . |
| 1372922 | 11/1974 | United Kingdom . |

OTHER PUBLICATIONS

"Press Working Handbook", Maruzen Co., Ltd., Oct. 1975.

*Primary Examiner*—David Jones
*Assistant Examiner*—Rodney A. Butler
*Attorney, Agent, or Firm*—Foley & Lardner

[57] ABSTRACT

A metal ring producing device comprises a rigid roller and a resilient roller. The resilient roller has an outer cylindrical portion covered with an elastic annular member. The resilient roller is positioned near the rigid roller so that a metal plate member can be inserted between the resilient and rigid rollers. The resilient roller is rotated in a given direction. The elastic annular member is formed with equally spaced recesses. Each recess has a concave bottom surface which is shaped in conformity with an outer surface of the metal ring produced around the rigid roller. A ring removing mechanism is further employed which pushes one end of the metal ring and thus thrusts the metal ring off the rigid roller when the resilient roller stops at a position wherein one of the recesses is registered with the rigid roller.

17 Claims, 8 Drawing Sheets

DEVICE FOR PRODUCING METAL RINGS

BACKGROUND OF THE INVENTION

1. Field of the Invention

The present invention relates to devices for producing metal rings, and more particularly to devices for curling metal plate members to produce rings. More specifically, the present invention is concerned with metal ring producing devices of a so-called "double roller" type which comprises a rigid roller and a resilient roller between which the metal plate member is inserted to be curled for production of the metal ring.

2. Description of the Prior Art

For producing metal rings, the double roller type devices have been hitherto employed. Some of them are shown in "Press Working Handbook" issued Oct. 25, 1975 from MARUZEN CO., LTD. As is shown in FIG. 12 of the accompanying drawings, in these devices, a rigid roller 13 and a resilient roller 11 are used which are arranged in parallel keeping a slight contact therebetween. When, as shown in the drawing, a metal plate member 15 having a given length is inserted between the rigid and resilient rollers 13 and 11 and then the resilient roller 11 is rotated in the direction of the arrow "11*a*", the metal plate member 15 is curled and finally wound around the rigid roller 13 in a manner as shown in FIG. 13. The curled plate member 15, which is thus shaped like a ring 17, is removed from the rigid roller 13 and then welding is applied to opposed edges of the ring 17 to complete the same.

For ease of description, in the following, the ring which has not been subjected to the welding will be referred to just "ring", while, the ring which has been subjected to the welding will be referred to "finished ring".

As shown in FIG. 14, the resilient roller 11 comprises two opposed circular flanges 19, a cylindrical core portion 21 concentrically disposed between the two flanges 19 and an elastic annular member 23 put around the core portion 21. The elastic annular member 23 is bonded to the core portion 21. As shown, peripheries of the flanges 19 extend radially outward beyond an outer surface of the elastic annular member 23 thereby to define therebetween a shallow annular groove 19*a*. The elastic annular member 23 is a rubber ring, a soft plastic ring or the like. The shallow annular groove 19*a* is shaped and sized to neatly receive the metal plate member 15 (or the ring 17 put around the rigid roller 13).

In order to remove or release the ring 17 from the rigid roller 13, the conventional double roller type device has a roller shifting mechanism (not shown) by which one of the two rollers 13 and 11 is moved away from the other to define a certain clearance between the two rollers 13 and 11. However, usage of such roller shifting mechanism makes the device complicated in construction, and operation of such roller shifting mechanism causes the device to fail to exhibit a satisfied production speed of the rings 17.

SUMMARY OF THE INVENTION

It is therefore an object of the present invention to provide a metal ring producing device of the double roller type, which is free of the above-mentioned drawbacks.

According to a first aspect of the present invention, there is provided a metal ring producing device for producing a metal ring from a substantially flat metal plate member. The device comprises a rigid roller; a resilient roller having an outer cylindrical portion covered with an elastic annular member, the resilient roller being positioned in the vicinity of the rigid roller so that the metal plate member can be inserted between the resilient and rigid rollers; first means for driving the resilient roller to rotate in a given direction; second means for providing the elastic annular member of the resilient roller with equally spaced recesses, each recess having a concave bottom surface which is shaped in conformity with an outer surface of the metal ring produced around the rigid roller; and third means for pushing one end of the metal ring and thus thrusting the metal ring off the rigid roller when the resilient roller stops at a position wherein one of the recesses is registered with the rigid roller.

According to a second aspect of the present invention, there is provided a metal ring producing device for producing a metal ring from a substantially flat metal plate member. The device comprises a rigid roller having a rigid outer cylindrical surface; a resilient roller including two opposed circular flanges, a cylindrical core portion concentrically disposed between the two opposed circular flanges, and an elastic annular member concentrically disposed on an outer surface of the cylindrical core portion, peripheries of the flanges extending radially outward beyond the outer surface of the elastic annular member thereby to define therebetween a shallow annular groove; first means for driving the resilient roller to rotate in a given direction; second means for providing the outer peripheral portion of the resilient roller with equally spaced recesses, each recess having a concave bottom surface which is shaped in conformity with an outer surface of the metal ring produced around the rigid roller; and third means for pushing one end of the metal ring and thus thrusting the metal ring off the rigid roller when the resilient roller stops at a position wherein one of the recesses is registered with the rigid roller.

According to a third aspect of the present invention, there is provided a system which comprises a metal plate member supplier including a case in which a plurality of metal plate members are to be stored in stacked manner, and a plate member transferring mechanism for transferring the metal plate members from the case to a given position one after another; and a metal ring producing device for producing a ring from the metal plate member which has been transferred to the given position, the metal ring producing device including a rigid roller, a resilient roller having an outer cylindrical portion covered with an elastic annular member, the resilient roller being positioned in the vicinity of the rigid roller so that the metal plate member can be inserted between the resilient and rigid rollers, first means for driving the resilient roller to rotate in a given direction, second means for providing the elastic annular member of the resilient roller with equally spaced recesses, each recess having a concave bottom surface which is shaped in conformity with an outer surface of the metal ring produced around the rigid roller, and third means for pushing one end of the metal ring and thus thrusting the metal ring off the rigid roller when the resilient roller stops at a position wherein one of the recesses is registered with the rigid roller.

According to a fourth aspect of the present invention, there is provided a metal ring producing method in a metal ring producing device, the device comprising a rigid roller; a resilient roller having an outer cylindrical portion covered with an elastic annular member, the resilient roller being positioned in the vicinity of the rigid roller so that the metal plate member can be inserted between the rigid roller and the resilient roller, the elastic annular member being formed with equally spaced recesses each extending axially and having a concave bottom surface which is shaped in conformity with an outer surface of the metal ring produced around the rigid roller; and means for driving the resilient roller to rotate in a given direction, the method comprising the steps of: (a) transferring the metal plate member to the resilient roller at a position separated from one of the recesses by a given angle; (b) rotating the resilient roller in a given direction winding the metal plate member around the rigid roller; (c) continuing the rotation of the resilient roller until a subsequent recess comes to the rigid roller; (d) removing the produced ring from the rigid roller; (e) rotating the resilient roller in the same direction to an angular position wherein the subsequent recess is advanced from the rigid roller by the given angle.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
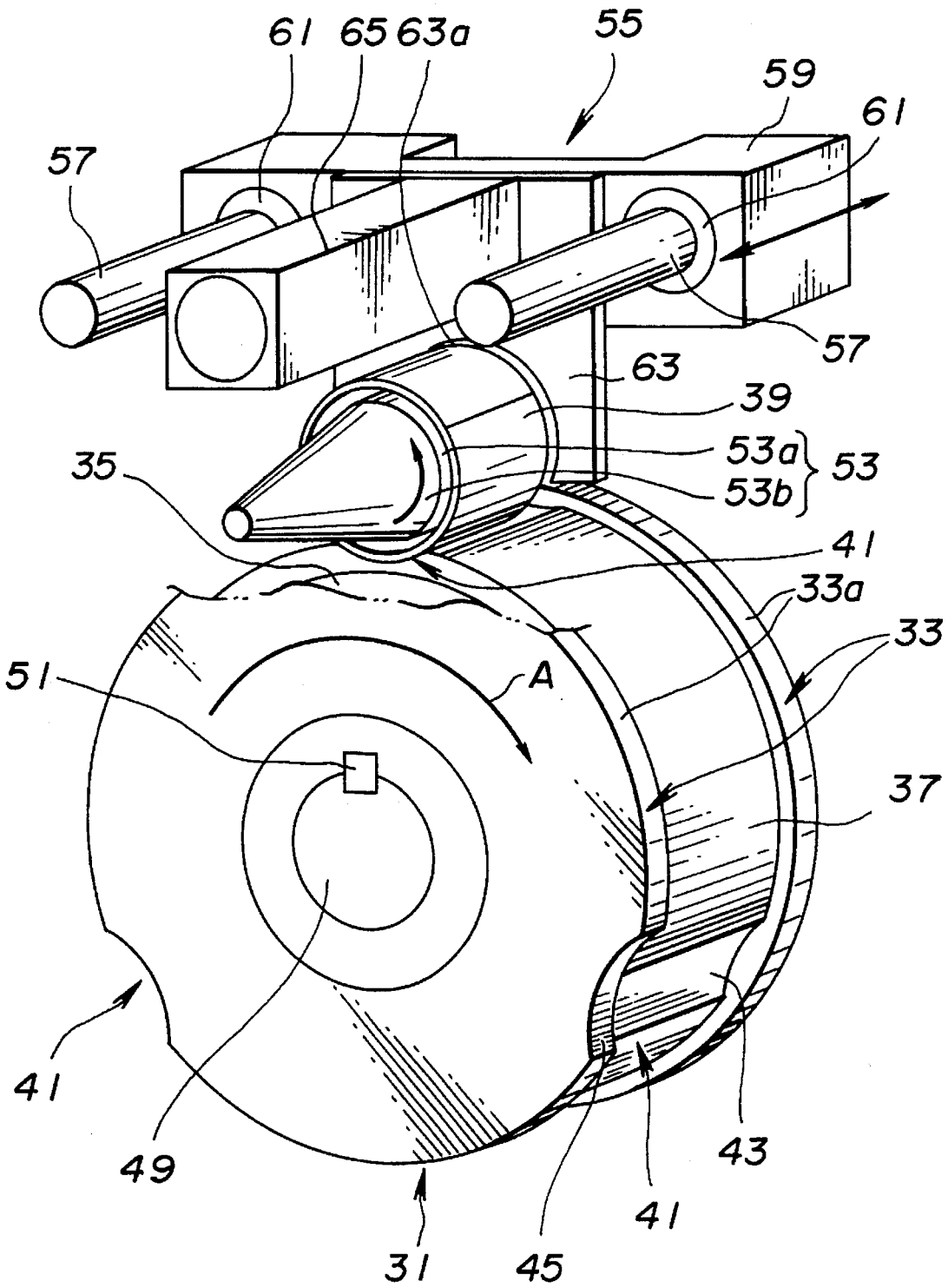
FIG. 1 is a perspective view of an essential portion of a metal ring producing device according to the present invention.

Referring to FIG. 1 of the drawings, there is shown an essential portion of a metal ring producing device according to the present invention.

In the drawing, denoted by numeral 31 is a resilient roller which is positioned in the vicinity of a rigid roller 53 and arranged in parallel with the same, as shown.

Figure 2:
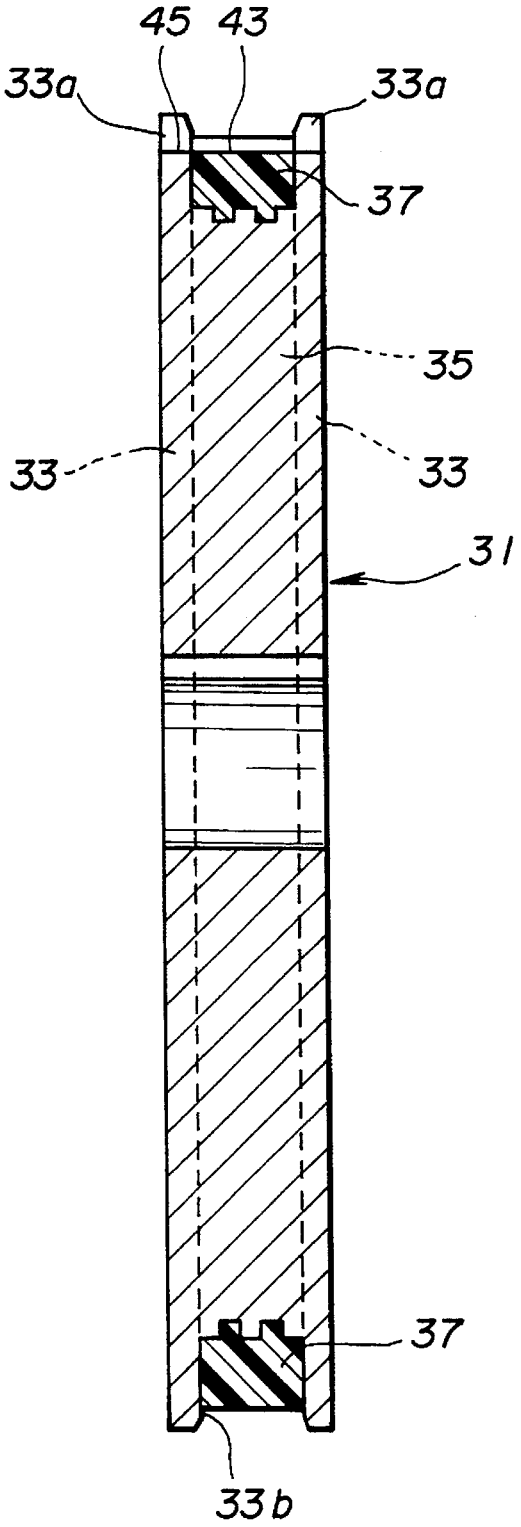
FIG. 2 is an enlarged sectional view of a resilient roller used in the metal ring producing device of the present invention.

As is seen from FIG. 2, the resilient roller 31 comprises two opposed circular flanges 33, a cylindrical core portion 35 concentrically disposed between the two flanges 33 and an elastic annular member 37 put around the core portion 35. The flanges 33 and the core portion 35 are constructed of a metal and preferably of an integral construction. Peripheries 33*a* of the flanges 33 extend radially outward beyond an outer surface of the elastic annular member 37 thereby to define therebetween a shallow annular groove 33*b*. As will become apparent as the description proceeds, the shallow annular groove 33*b* functions to guide metal plate members 79 supplied thereto from a metal plate member supplier 77 (see FIG. 4). More specifically, the width of the shallow annular groove 33*b* is somewhat greater than that of the metal plate member 79.

The elastic annular member 37 is bonded to the core portion 35. Preferably, the elastic annular member 37 is made of a polyurethane rubber.

In the present invention, the following measure is employed for achieving a smooth and quick removal of a produced ring 39 from the rigid roller 53.

For ease of description, the ring 39 which has not been subjected to the afore-mentioned welding will be referred to just "ring".

Figure 5:
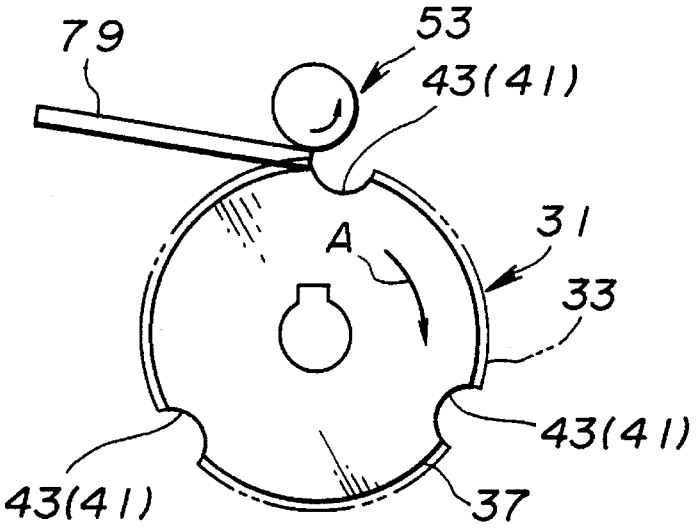
FIGS. 5 and 6 are schematic illustrations of the device of the invention showing steps for making a metal ring from a metal plate member.
Figure 6:
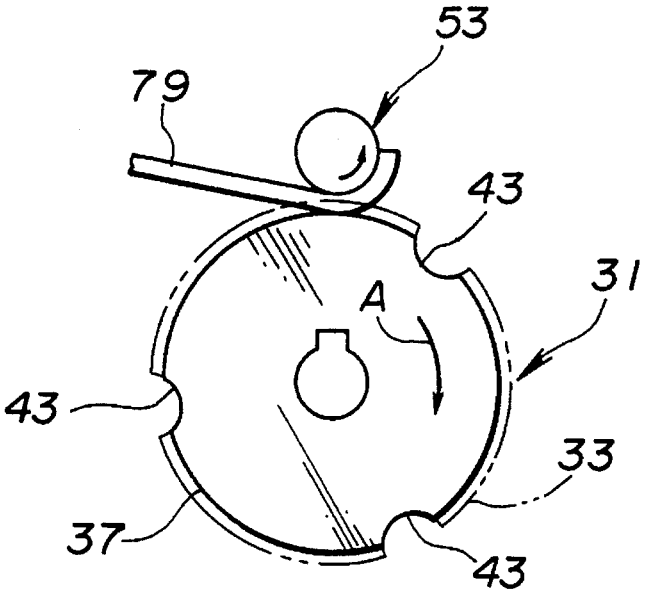

As will be understood from FIGS. 1 and 5, the resilient roller 31 is formed at its peripheral portion with three equally spaced cut portions 41. That is, these cut portions 41 are spaced from one another by 120 degrees in angle.

For the reason which will become apparent hereinafter, the length of the arc defined on the curved outer surface of the elastic annular member 37 between adjacent two cut portions 41 should be greater than that of the metal plate member 79.

As is seen from FIG. 1, each cut portion 41 comprises a rounded recess 43 formed in the elastic annular member 37 and a rounded recess 45 formed in the periphery of one of the flanges 33, the two rounded recesses 43 and 45 being merged to constitute a single rounded groove. It is to be noted that the flange 33 having the recesses 45 is positioned outside when properly assembled.

The depth of the recess 43 of the elastic annular member 37 is, for example, about 2 mm which is greater than the deformation of the elastic annular member 37 which appears when the metal plate member 79 is being curled by the two rollers 31 and 53. The concave bottom surface of the recess 43 has a curvature substantially equal to that of the ring 39 put around the rigid roller 53. The concave bottom surface of the recess 45 of the flange 33 has a curvature substantially equal to that of the ring 39 put around the rigid roller 53.

For the reasons which will become apparent hereinafter, if desired, the other flange 33 may be formed with corresponding recesses.

The resilient roller 31 is formed with a center bore (no numeral) into which a drive shaft 49 from an after-mentioned drive unit is inserted. A key 51 is used for securing the drive shaft 49 to the resilient roller 31.

The rigid roller 53 is positioned just above the resilient roller 31. The rigid roller 53 is constructed of a rigid metal. As will become apparent hereinafter, in a stand-by condition of the resilient roller 31, the rigid roller 53 is slightly pressed against the resilient roller 31.

As shown in FIG. 1, the rigid roller 53 comprises a right cylindrical portion 53*a* around which the metal plate member 79 is to be wound and a conical portion 53*b* along which the ring 39 is to be slid down upon removal from the rigid roller 53.

As shown, above the rigid roller 53, there is arranged a ring removing mechanism 55 which functions to remove or release the ring 39 from the rigid roller 53.

The ring removing mechanism 55 comprises two parallel guide shafts 57 which extend horizontally, that is, in the direction parallel to the axis of the rigid roller 53. As will be seen from FIG. 3, the guide shafts 57 are secured at their inner ends to a base structure 47.

Referring back to FIG. 1, a moving unit 59 is slidably supported by the two guide shafts 57 through respective bearings 61. The moving unit 59 carries a push plate 63 for pushing the ring 39 on the rigid roller 53 outward. The push plate 63 is formed with a semicircular opening 63*a* whose diameter is larger than that of the rigid roller 53 but smaller than that of the ring 39. Thus, when, with the ring 39 left on the rigid roller 53, the moving unit 59 is slid toward this side in FIG. 1, the push plate 63 pushes the ring 39 and finally thrusts the same off the rigid roller 53.

The moving unit 59 has a pneumatic cylinder 65 connected thereto. As is seen from FIG. 3, a piston rod 65*a* from the cylinder 65 is connected at its leading end to the base structure 47. Thus, when the cylinder 65 is filled with compressed air, the moving unit 59 is slid in the direction to thrust the ring 39 off the rigid roller 53.

Figure 3:
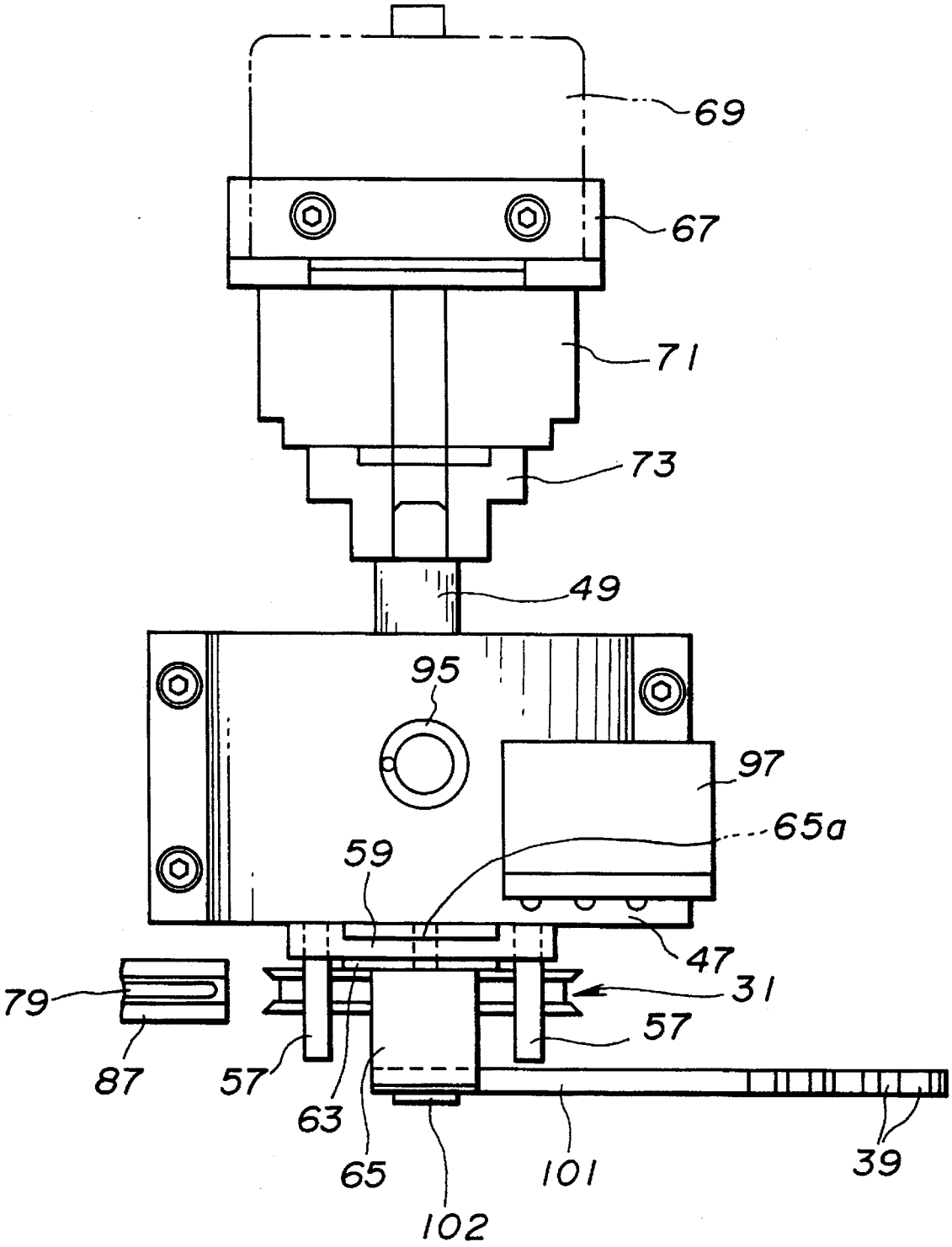
FIG. 3 is a plan view showing the entire of the metal ring producing device of the invention.

In FIG. 3, denoted by numeral 69 is an electric motor which is mounted on a bracket 67. The rotation of the motor 69 is transmitted to the drive shaft 49 (see FIG. 1) of the resilient roller 31 through a speed change device 71 and a shaft joint 73. Thus, when the motor 69 is energized, the resilient roller 31 is rotated at a given speed in the direction of the arrow "A" in FIG. 1.

Figure 4:
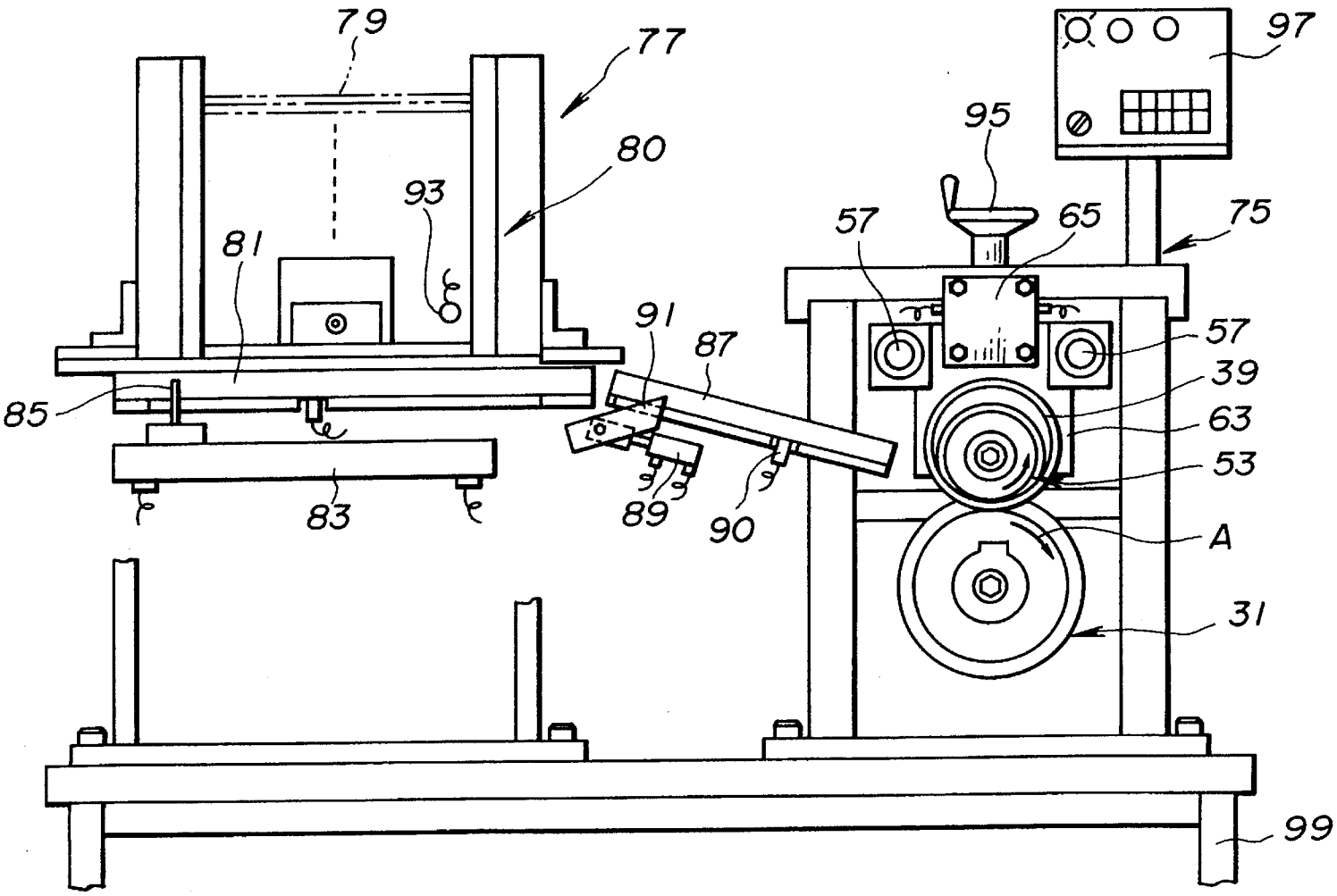
FIG. 4 is a front view of a system for producing the metal ring, which system incorporates thereinto the metal ring producing device of the present invention.

In FIG. 4, there is shown the entire of a metal ring producing system which generally comprises the metal ring producing device 75 of the invention and a metal plate member supplier 77.

As shown in FIG. 4, the metal plate member supplier 77 has a rectangular case 80 in which a plurality of metal plate members 79 are stored in stacked manner. Below the case 80, there is arranged a first shoot 81 onto which the lowest one of the metal plate members 79 in the case 80 is dropped. The metal plate member 79 thus dropped is then shifted to a second shoot 87 by means of a pawl member 85 of a pneumatically operated plate member shifter 83. As shown, the second shoot 87 is inclined having a leading end directed toward the contacting portion between the resilient roller 31 and the rigid roller 53. The metal plate member 79 thus shifted to the second shoot 87 is then led to the contacting portion between the resilient and rigid rollers 31 and 53 by means of a pawl member 91 of a pneumatically operated plate member mover 89.

In the drawing, designated by numeral 93 is a plate member sensor which is arranged in the case 80 for sensing presence or absence of the plate member 79. Designated by numeral 95 is a handle for adjusting the distance between the resilient roller 31 and the rigid roller 53, designated by numeral 97 is a control panel and designated by numeral 99 is a pedestal structure of the metal ring producing system.

Referring back to FIG. 3, there is shown a ring carrying device which functions to carry the ring 39, which has been just released from the rigid roller 53, to a desired outside position. The ring carrying device comprises a stopper plate 102 which faces the rigid roller 53 and a third shoot 101 which has one end portion positioned below the stopper plate 102. The third shoot 101 is inclined extending to the desired position. It is to be noted that in FIG. 4, the ring carrying device is not shown for clarification of arrangement of other parts.

In the following, operation of the metal ring producing device 75 of the present invention will be described with reference to FIGS. 4, 5, 6 and 1. It is to be noted that the resilient roller 31 is at a standstill until the metal plate member 79 is fed thereto.

When, as is understood from FIGS. 4 and 5, the metal plate member 79 is transferred from the second shoot 87 to the contacting portion between the resilient and rigid rollers 31 and 53, the resilient roller 31 starts to rotate in the direction of the arrow "A" by energizing the motor 69 (see FIG. 3). Thus, thereafter, as is seen from FIG. 6, the metal plate member 79 is gradually curled in accordance with the rotation of the resilient roller 31. When the rotation of the resilient roller 31 reaches 120 degrees in angle and thus, as is seen from FIG. 1, one of the cut portions 41 thereof becomes registered with the rigid roller 53, the resilient roller 31 is stopped by deenergizing the motor 69. Upon this, the metal plate member 79 is fully wound around the rigid roller 53 (more specifically, around the cylindrical portion 53*a* of the rigid roller 53) to produce a ring 39. Since, under this condition, the ring 39 is in the cut portion 41 of the resilient roller 31, the ring 39 is not pressed by the elastic annular member 37, which means that the ring 39 can easily move on and along the rigid roller 53. Then, the pneumatic cylinder 65 is energized to move the push plate 63 of the ring removing mechanism 55 along the guide shafts 57. With this, the ring 39 is thrust off the rigid roller 53 through the conical portion 53*b* of the rigid roller 53.

If desired, the following steps may be used for making the ring 39, which are depicted by FIGS. 7 to 10.

Figure 7:
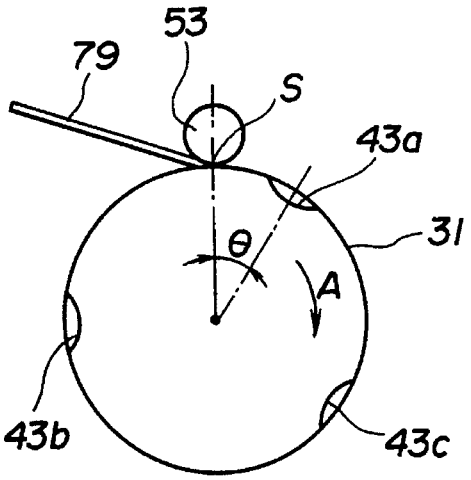
FIGS. 7 to 10 are illustrations similar to those of FIGS. 5 and 6, but showing modified steps for making a metal ring from the metal plate member.
Figure 8:
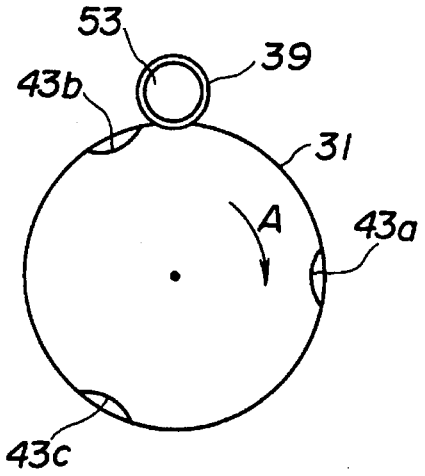
Figure 9:
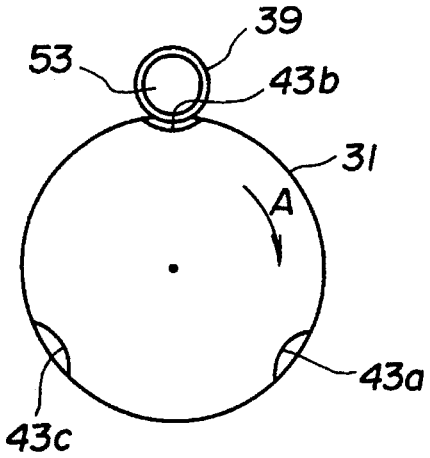
Figure 10:
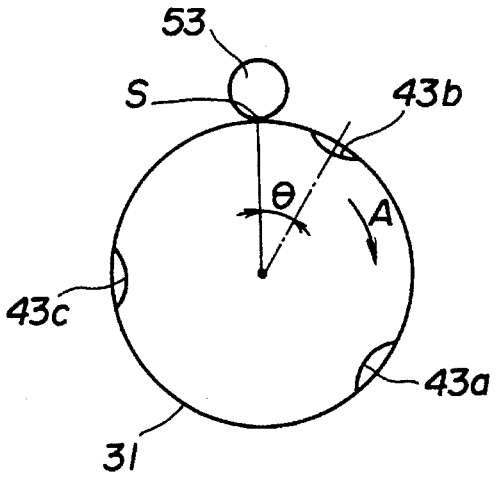

As is seen from FIG. 7, when the device is in the stand-by condition, the resilient roller 31 takes a position wherein one 43*a* of the recesses 43*a*, 43*b* and 43*c* is advanced in angle from the rigid roller 53 by a given degree "θ". Then, the metal plate member 79 is transferred to the resilient roller 31 at a position "S" separated from the recess 43*a* by the angle "θ". Then, as is seen from FIG. 8, the resilient roller 31 is rotated in the direction of the arrow "A" winding the metal plate member 79 around the rigid roller 53. As will be understood from this drawing, formation of the ring 39 is completed before the subsequent recess 43*b* comes to the rigid roller 53. When the subsequent recess 43*b* comes to the rigid roller 53 as is shown in FIG. 9, the resilient roller 31 is stopped. Then, the pneumatic cylinder 65 (see FIG. 3) is energized to remove the ring 39 from the rigid roller 53 in such a manner as has been described hereinabove. Then, as is seen from FIG. 10, the resilient roller 31 is rotated again in the same direction "A" to an angular position "S" wherein the recess 43*b* is advanced from the rigid roller 53 by the angle "θ", that is, the position ready for receiving a subsequent metal plate member 79.

As will be seen from FIG. 3, the ring 39 thus released from the rigid roller 53 is brought to the desired outside position by means of the ring carrying device. That is, when released from the rigid roller 53, the ring 39 collides against the stopper plate 102 and thus drops to the third shoot 101 and then runs down along the shoot 101 to the desired position.

Figure 11:
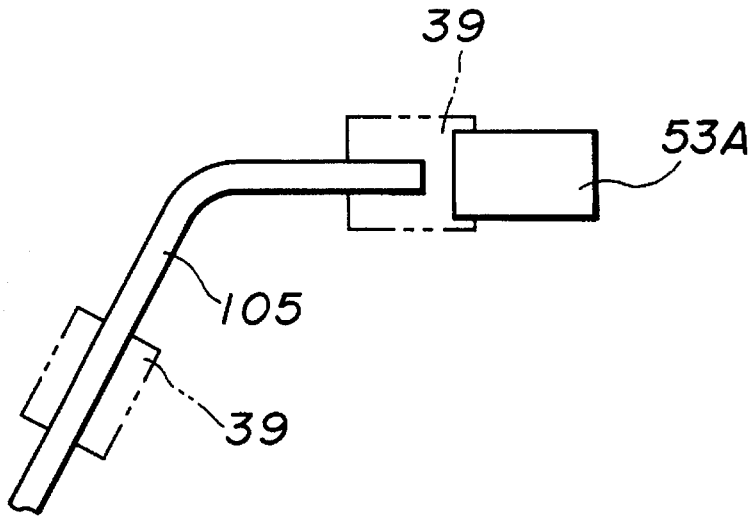
FIG. 11 is a schematic illustration showing an example of a ring carrying device for carrying a produced metal ring from the rigid roller to a desired outside position.
Figure 12:
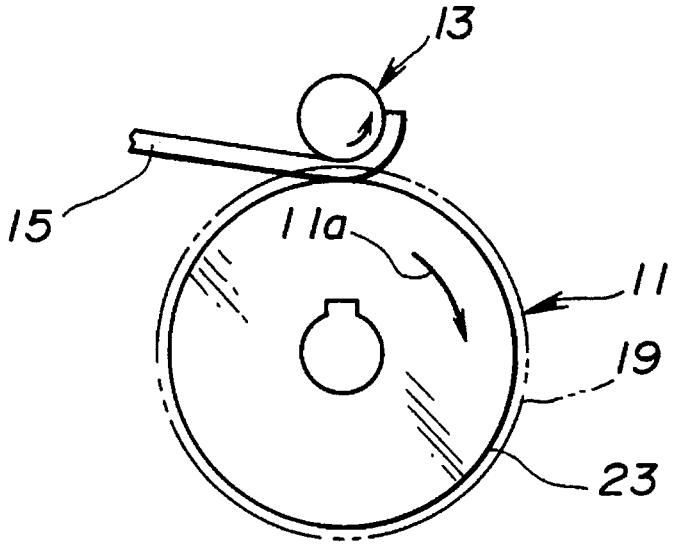
FIG.12 (PRIOR ART)
FIG. 12 is an illustration similar to FIG. 5, but showing a conventional metal ring producing device.
Figure 13:
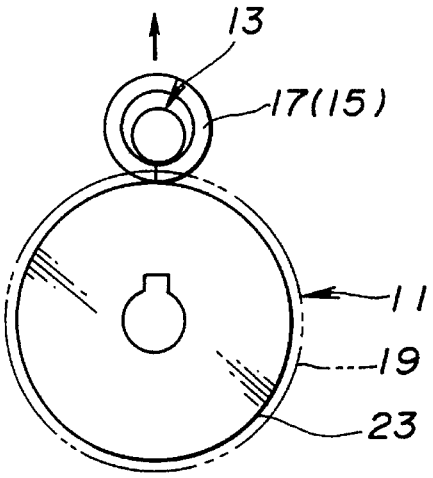
FIG.13 (PRIOR ART)
FIG. 13 is an illustration of the conventional ring producing device, but showing a condition wherein curling of the metal plate member is finished and thus a metal ring is produced.
Figure 14:
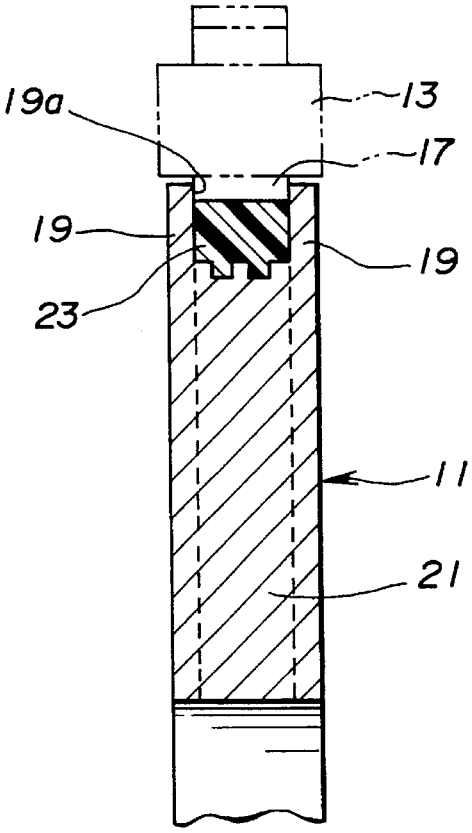
FIG.14 (PRIOR ART)
FIG. 14 is a sectional view of a resilient roller employed in the conventional metal ring producing device.

If desired, another ring carrying device may be used, which is shown in FIG. 11. In this case, the conical portion 53*b* of the rigid roller 53A may be removed, as shown. The ring carrying device comprises a guide bar 105 which has an upper end positioned near and directed toward the rigid roller 53*a* and a lower portion extending downward to a desired position. That is, the ring 39 released from the rigid roller 53A is received on the upper end of the guide bar 105 and slid down along the guide bar 105 to the desired position.

Due to repeated load applied by the metal plate members 79, given portions of the elastic annular member 37 finally show a permanent set which lowers the ring production ability of the device 75. Thus, when such permanent set is grown up to a marked level, the resilient roller 31 is changed with a new one. However, if the permanent set is not so marked, the elastic annular member 37 may be abraded to smooth the outer surface thereof. With this, the life of the resilient roller 31 can be prolonged.

If, as has been mentioned hereinbefore, both of the flanges 33 of the resilient roller 31 are formed with the rounded recesses 45, the life of the resilient roller 31 (more specifically, the life of the elastic annular member 37) can be much more prolonged. That is, when a certain number of metal plate members 79 are treated, the resilient roller 31 may be turned over.

In the following, operation of the entire system for producing the metal rings will be briefly described with reference to FIG. 4.

When, as has been mentioned hereinabove, the ring 39 is produced on the rigid roller 53, the pneumatic cylinder 65 is energized to remove the ring 39 from the rigid roller 53. Then, the cylinder 65 is deenergized causing the push plate 63 to return to its rest position. The movement of the push plate 63 to the rest position is sensed by a sensor (not shown). Upon receiving a signal from the sensor, the motor 69 is energized to rotate the resilient roller 31 in the direction of the arrow "A" by about 10 degrees in angle. Thus, under this stand-by condition, the rigid roller 53 is lightly pressed against the elastic annular member 37. Upon sensing this stand-by condition of the resilient roller 31, a metal plate member 79 which has been in the second shoot 87 is moved to the resilient roller 31 by the pawl member 91 of the pneumatically operated plate member mover 89. Upon sensing a proper setting of the metal plate member 79 to the resilient roller 31 by a sensor 90, the motor 69 is energized to rotate the resilient roller 31 in the direction of the arrow "A". With this, the plate member 79 is wound around the rigid roller 53 to produce the ring 39. In response to rotation of the resilient roller 31, the pawl member 91 is returned back to its stand-by position. After long use of the system, the stand-by position of the resilient roller 31 may be changed for example to a position of about 15 degrees from the registered position. With this position change, the undesired permanent set of the elastic annular member 37 can be avoided or at least minimized.

Although the above description is made with respect to the metal plate members 79 having the same size, the ring producing device 75 of the invention can be applied to metal plate members 79 having different lengths so long as they are shorter than the length of arc defined between adjacent two of the cut portions 41 of the resilient roller 31. That is, in this case, the metal plate members 79 can be randomly but one after another fed to the ring producing device 75. However, the resilient roller 31 should be turned to the given position to establish the registration of one cut portion 41 with the rigid roller 53 each time a ring 39 is produced around the rigid roller 53. Since, in this case, the metal plate members 79 are fed to different positions of the elastic annular member 37, the member 37 is evenly abraded and thus the life of the same can be prolonged.

As is described hereinabove, in the ring producing device of the present invention, the resilient roller 31 is formed at the periphery thereof with a plurality (three in the illustrated embodiment) of cut portions 41 which can be registered with the rigid roller 53 upon production of the ring 39 on the rigid roller 53. Thus, the ring 39 can be easily released from the rigid roller 53 by the push plate 63 of the ring removing mechanism 55. It is to be noted that the release of the ring 39 is accomplished without moving one of the resilient and rigid rollers 31 and 53 away from the other.

What is claimed is:

1. A device for producing a metal ring from a substantially flat metal plate member, comprising:

a rigid roller;

a resilient roller having an outer cylindrical portion covered with an elastic annular member, said resilient roller being positioned in a vicinity of said rigid roller so that said metal plate member can be inserted between said rigid roller and said resilient roller;

first means for driving said resilient roller to rotate in a given direction such that said metal plate member is wound around said rigid roller;

second means for providing the elastic annular member of said resilient roller with a plurality of equally spaced recesses, each recess extending in an axial direction parallel with an axis of said resilient roller and having a concave bottom surface which is shaped in conformity with an outer surface of the metal ring wound around said rigid roller; and third means for pushing said metal ring and thus thrusting said metal ring off the rigid roller when said resilient roller stops at a position wherein one of said recesses is registered with said rigid roller.

2. A device as claimed in claim 1, in which each recess of said elastic annular member has a depth which is greater than a deformation of the elastic annular member which appears when said metal plate member is being curled by the resilient and rigid rollers.

3. A device as claimed in claim 2, in which an arc defined between two adjacent recesses has a length which is greater than that of the metal plate member.

4. A device as claimed in claim 2, in which said elastic annular member is constructed of polyurethane rubber.

5. A device as claimed in claim 3, in which each recess is shaped and sized such that when the metal ring is wound and left on said rigid roller, the recess comes into registration with the rigid roller, thereby preventing said metal ring from being pressed by said elastic annular member.

6. A device as claimed in claim 5, in which said third means comprises:

a moving unit movable in parallel with the axis of said rigid roller; and a push plate connected to said moving unit to move therewith, said push plate being formed with a semicircular opening whose diameter is larger than that of said rigid roller but smaller than that of said metal ring.

7. A device as claimed in claim 6, in which said moving unit is moved by means of a pneumatically operated cylinder unit.

8. A device for producing a metal ring from a substantially flat metal plate member, comprising:

a rigid roller having a rigid outer cylindrical surface;

a resilient roller including two opposed circular flanges, a cylindrical core portion concentrically disposed between said two opposed circular flanges, and an elastic annular member concentrically disposed on an outer surface of said cylindrical core portion, peripheries of said flanges extending radially outward beyond the outer surface of the elastic annular member thereby to define therebetween a shallow annular groove;

first means for driving said resilient roller to rotate in a given direction;

second means for providing the outer peripheral portion of said resilient roller with a plurality of equally spaced recesses, each recess extending in an axial direction parallel with an axis of said resilient roller having a concave bottom surface which is shaped in conformity with an outer surface of the metal ring produced around said rigid roller; and third means for pushing one end of said metal ring and thus thrusting said metal ring off the rigid roller when said resilient roller stops at a position wherein one of said recesses is registered with said rigid roller.

9. A metal ring producing device as claimed in claim 8, in which has a depth which each recess of said elastic annular member has a depth which is greater than a deformation of the elastic annular member which appears when said metal plate member is being curled by the resilient and rigid rollers.

10. A metal ring producing device as claimed in claim 8, in which said rigid roller comprises:

a right cylindrical portion around which the metal plate member is to be wound; and a conical portion protruded from one axial end of said right cylindrical portion.

11. A metal ring producing device as claimed in claim 8, in which said third means comprises:

two parallel guide shafts extending in parallel with the axis of said rigid roller;

a moving unit slidably supported by said two guide shafts so that the moving unit can move along the axis of said rigid roller;

a push plate connected to said moving unit to move therewith, said push plate being formed with a semi-circular opening whose diameter is larger than that of said rigid roller but smaller than that of said ring; and a pneumatically operated cylinder unit for driving said moving unit.

12. A metal ring producing device as claimed in claim 9, in which each of said recesses of said resilient roller comprises:

a first rounded recess formed in said elastic annular member; and a second rounded recess formed in the periphery of one of said flanges, wherein said first and second rounded recesses are merged to constitute a single rounded groove.

13. A metal ring producing device as claimed in claim 12, in which each of said recesses of said resilient roller further comprises a third rounded recess formed in the periphery of the other of said flanges, said third rounded recess being merged with the first and second rounded recesses to constitute said single rounded groove.

14. A system comprising:

a metal plate member supplier including a case in which a plurality of metal plate members are to be stored in a stacked manner, and a plate member transferring mechanism for transferring the metal plate members from said case one after another; and a metal ring producing device for producing a ring from a metal plate member which has been transferred from said case, said metal ring producing device including a rigid roller, a resilient roller having an outer cylindrical portion covered with an elastic annular member, said resilient roller being positioned in the vicinity of said rigid roller so that said metal plate member can be inserted between the resilient and rigid rollers, first means for driving said resilient roller to rotate in a given direction, second means for providing the elastic annular member of said resilient roller with a plurality of equally spaced recesses, each recess extending in an axial direction parallel with an axis of said resilient roller having a concave bottom surface which is shaped in conformity with an outer surface of the metal ring produced around said rigid roller, and third means for pushing one end of said metal ring and thus thrusting said metal ring off the rigid roller when said resilient roller stops at a position wherein one of said recesses is registered with said rigid roller.

15. A system as claimed in claim 14, in which said metal plate member is transferred to a stand-by position on said rigid roller, said stand-by position being changed to another position when a predetermined number of metal plate members have been transferred.

16. In a metal ring producing device for producing a metal ring from a substantially flat metal plate member, said device comprising a rigid roller; a resilient roller having an outer cylindrical portion covered with an elastic annular member, said resilient roller being positioned in the vicinity of said rigid roller so that said metal plate member can be inserted between said rigid roller and said resilient roller, said elastic annular member being formed with a plurality of equally spaced recesses each extending axially and having a concave bottom surface which is shaped in conformity with an outer surface of the metal ring produced around said rigid roller; and means for driving said resilient roller to rotate in a given direction, a method for producing the metal ring, comprising the steps of:

(a) transferring the metal plate member to the resilient roller at a position separated from one of the recesses by a given angle;

(b) rotating said resilient roller in a given direction winding said metal plate member around said rigid roller;

(c) continuing the rotation of said resilient roller until a subsequent recess comes to said rigid roller;

(d) removing the produced ring from said rigid roller;

(e) rotating said resilient roller in the same direction to an angular position wherein said subsequent recess is advanced from said rigid roller by said given angle.

17. The method as claimed in claim 16, wherein said rotating of step (e) advances said rigid roller by an angle greater than said given angle when a predetermined number of metal rings are produced.

* * * * *